US007086797B1

(12) United States Patent
Huang

(10) Patent No.: US 7,086,797 B1
(45) Date of Patent: Aug. 8, 2006

(54) LIGHT-EMITTING PEN WITH PULLABLE COVER

(76) Inventor: Ming Huang, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/697,934

(22) Filed: Oct. 31, 2003

(51) Int. Cl.
*B43K 29/00* (2006.01)

(52) U.S. Cl. ..... 401/195; 362/118

(58) Field of Classification Search ..... 401/195, 401/52; 362/118, 119
See application file for complete search history.

(56) References Cited

U.S. PATENT DOCUMENTS 6,129,473 A * 10/2000 Shu ..... 401/195

6,231,204 B1 * 5/2001 Lo ..... 362/118

* cited by examiner

*Primary Examiner*—David J. Walczak

(57) ABSTRACT

A pullable light-emitting pen has a light-emitting body and a refill. The light-emitting body and the refill can act synchronously. Thereby, at night light is illuminated from the light-emitting pen so that the user can write easily. A cover is located at a top of the light-emitting pen. When the cover is pulled, the light-emitting body and the refill will protrude out from the pen tube for writing. When the cover descends, the light-emitting body does not light up again. Thus the light-emitting pen can be placed in a pocket. The light-emitting body and refill embeds into the pen tube. The power supply is hidden so as to have a beautiful outlook. The pulling of the cover can prevent the mistake of incorrectly lighting up so that power is saved. Decorations on the cover can present an attractive outlook.

9 Claims, 7 Drawing Sheets

PRIOR ARTS

PRIOR ARTS

LIGHT-EMITTING PEN WITH PULLABLE COVER

FIELD OF THE INVENTION

The present invention relates to light-emitting pens, and particular to a light-emitting pen which has a pullable cover. A switch is hidden in the pen body so that the switch will not destroy the outlook of the pen body. Thereby, the switch will not be touched by mistake and power will not be consumed due to the mistake.

BACKGROUND OF THE INVENTION

In the prior art ball pen, as shown in FIGS. 1 and 2, the control of the telescopic operation of a refill is illustrated. FIG. 1 shows a rotary control way and FIG. 2 shows the pressing control way. In FIG. 1, the rotary telescopic pen 9*a* has an upper section 91 and a lower section 92. When the upper section pen tube 91 is rotated, the refill 93 is controlled to protrude out or to embed into the pen tube. In the pressable telescopic pen 9*b* shown in FIG. 2, an elastic button 94 is installed at a distal end of the pen. The movement of the refill 95 is controlled by pressing the button 94.

The prior art pens are embedded with light-emitting element 96 in the pen tube. The light-emitting element includes LEDs, battery cells, and a casing for receiving the LEDs and the cells. Besides, a circuit switch 97 is added to the pen body for controlling the lighting up of the LEDs. The pressing button 94 is also as a switch. By the illumination of the LED, the pens have the function of illumination within a small range, or emitting signals or checking bills.

However, the prior art lighting emitting pen has the following disadvantages. The circuit switch protrudes from the pen body or the upper end thereof so that the appearance of the pen is not so beautiful and the manufacturing time is prolonged. The protruding switches are easily pressed by mistake so that power is wasted. The prior art pens have no decoration since the button is protruded so that the prior art pens cannot attract the attentions of children.

SUMMARY OF THE INVENTION

Accordingly, the object of the present invention is to provide a light-emitting pen. A switch is hidden in the pen body so that the switch will not destroy the outlook of the pen body. Thereby, the switch will not be touched by mistake and the power will not be consumed due to the mistake.

To achieve above object, the present invention provides a light-emitting pen with pullable cover. The light-emitting pen comprises an upper portion and a lower portion; the upper portion being a control portion and the lower portion being a pen tube; the pen tube being formed by a transparent outer tube; a refill within the transparent outer tube; and a spring being at a lower end of the refill so that the refill is retained in a reduced state in the pen tube; the control portion including a sleeve, a transparent outer tube connected to the sleeve; a cover on the sleeve; a light-emitting unit in the sleeve and a lower end thereof pressing the refill; a conductive terminal in the sleeve and on the light-emitting unit.

A cam swing rod is pivotally installed within a top of the sleeve. One side of the cam swing rod is a cam and another side thereof is a hook plate. An inner wall of the cover is installed with an upper block and a lower end thereof is a lower block. The upper and lower blocks are on the upper and lower sides of the hook plate. A bottom end of the conductive terminal is installed with a conductive reed. The conductive reed resists against a top of the light-emitting unit and is in contact with the battery electrode at the top thereof. By the expansion of the conductive reed, the conductive terminal has a gap from a top of the light-emitting unit.

A casing top of the light-emitting unit receives a light-emitting body and has a long conductive pin extended from the light-emitting body. The long conductive pin is not in contact with the battery electrode. A short conductive pin of the light-emitting body is directly in contact to another battery electrode.

The various objects and advantages of the present invention will be more readily understood from the following detailed description when read in conjunction with the appended drawing.

DETAILED DESCRIPTION OF THE INVENTION

Figure 1:
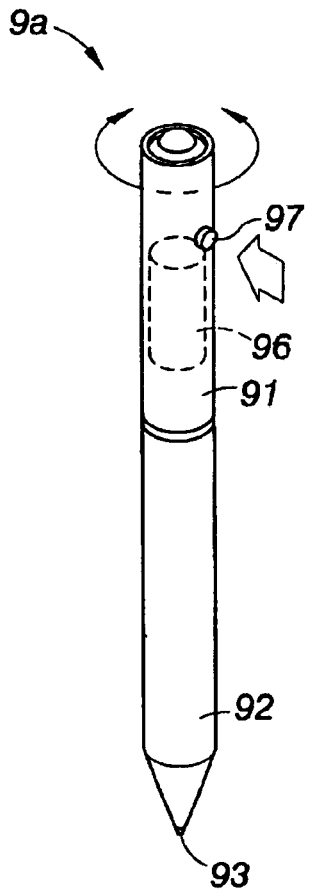
FIG. 1 shows the embodiment of a prior art light-emitting pen.
Figure 2:
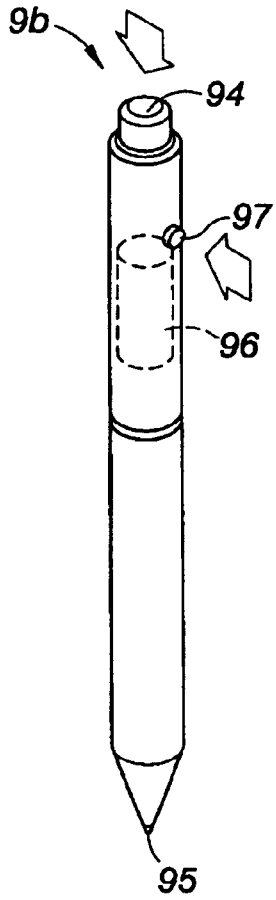
FIG. 2 shows the embodiment of the prior art light-emitting pen.

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

An exploded perspective view of the present invention is illustrated. The light-emitting pen 10 is formed by an upper portion and a lower portion. The upper portion is a control portion 1 and the lower portion is a pen tube 2. The control portion 1 is formed by a sleeve I1, a connecting ring 12, a cover 13, a light-emitting unit 14, and a conductive terminal 15. The pen tube 2 is formed by a transparent outer tube 21, a transparent inner tube 22, a refill 23, a spring 24, and a conductive enclosure 25. A perspective view showing that the control portion 1 is assembled to the pen tube 2, is illustrated.

Figure 3:
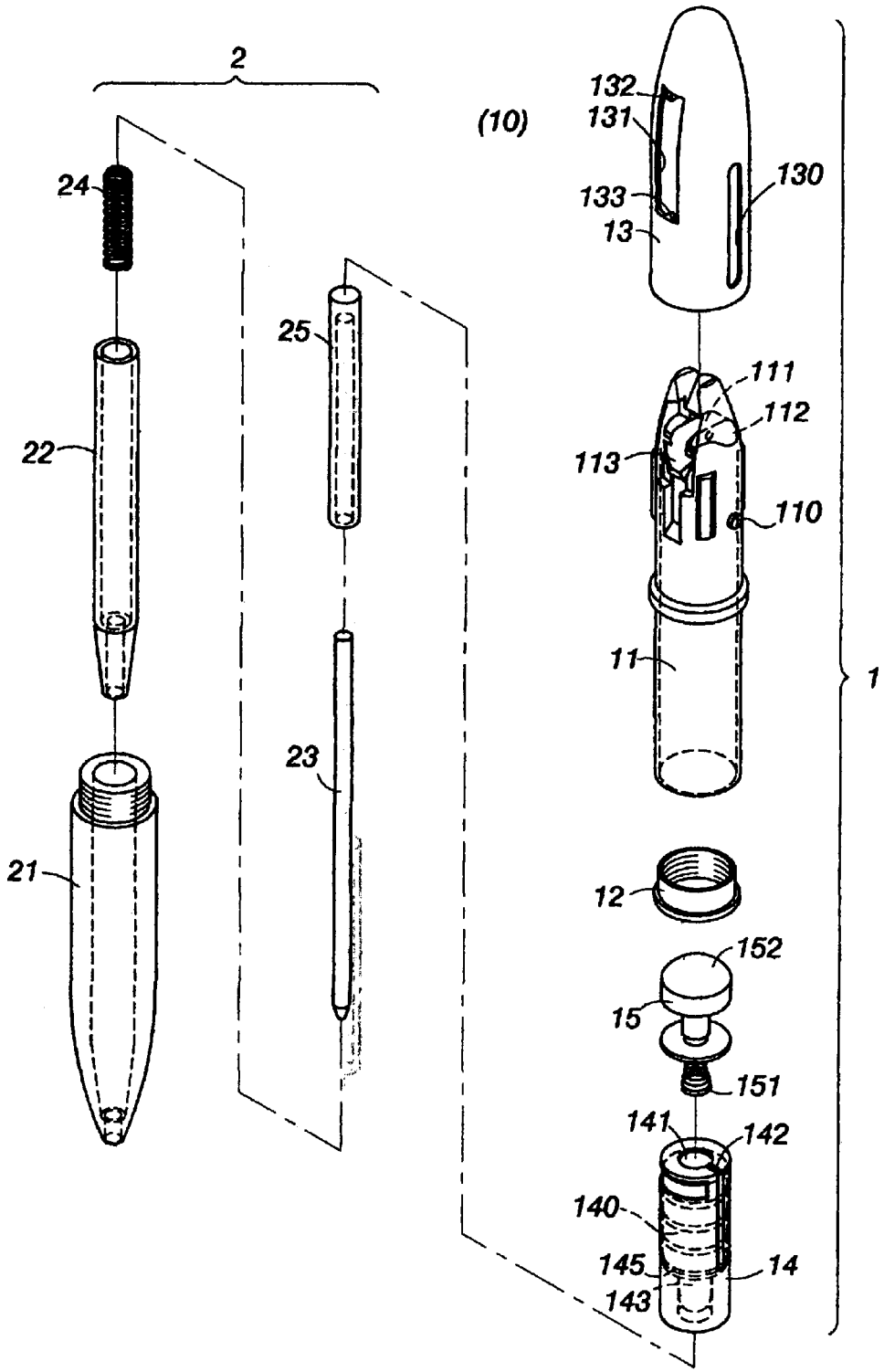
FIG. 3 is an exploded perspective view of the light-emitting pen of the present invention.
Figure 4:
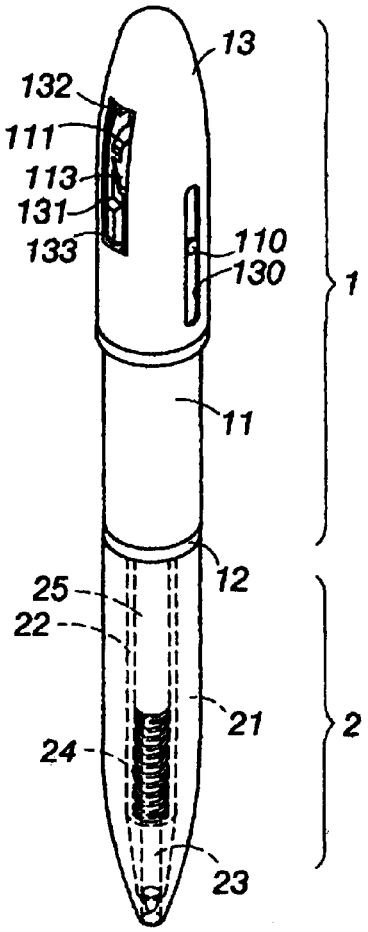
FIG. 4 is an assembled perspective view of the light-emitting pen of the present invention.
Figure 5:
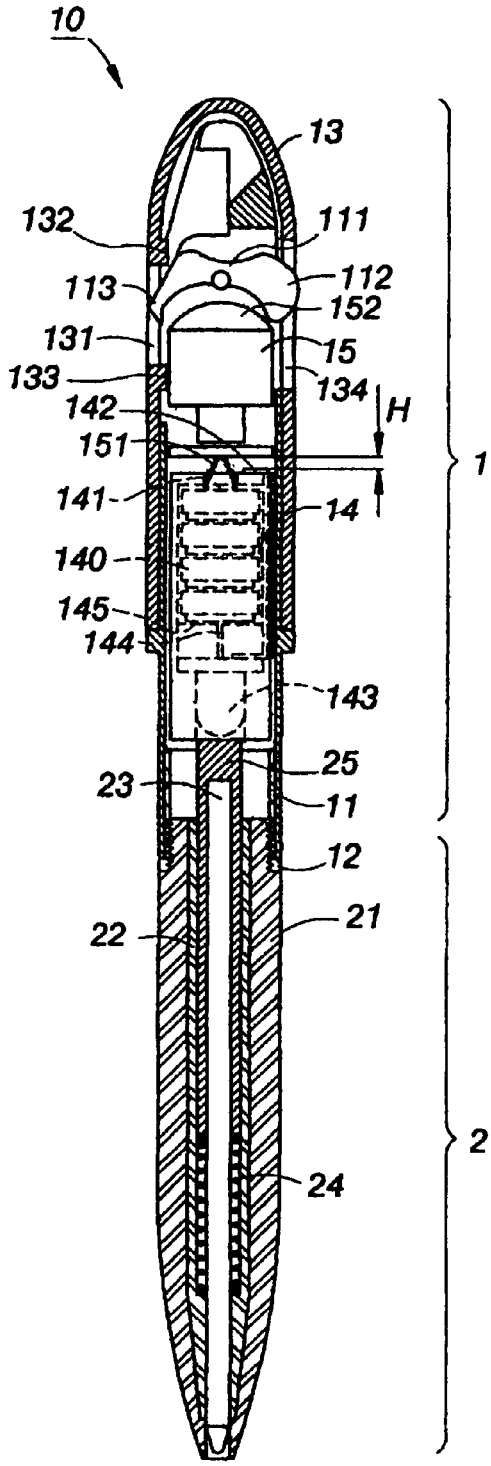
FIG. 5 is a cross section view of the light-emitting pen of the present invention.

With reference to FIGS. 3 and 5, FIG. 5 is a cross section view of the light-emitting pen of the present invention. In FIG. 5, a lower end of the sleeve 11 is connected to the top of the transparent outer tube 21. To avoid that a twisting force is applied to the lower end of the sleeve 11 in screwing; a metal connecting ring 12 is planted to a bottom of the sleeve 11 and then the connecting ring 12 is screwed to the top of the transparent outer tube 21 for preventing the bottom of the sleeve 11 to break. Furthermore, a cam swing rod 111 is installed at a top of the interior of the sleeve 11. One side of the cam swing rod 111 is a cam 112 and another side thereof is a hook plate 113.

Furthermore, two sides of the cover 13 have respective guide recess 130 for coupling to the studs 110 at two sides of the sleeve 11 so that the studs 10 can reciprocate on the sleeve 11. Moreover, one end of the cover 13 corresponding to the hook plate 113 has a trench 131. An upper edge at an inner side of the trench 131 is installed with an upper block 132 and a lower edge at the inner side of the trench 131 has a lower block 133. One end of the cover 13 corresponding to the cam 112 has a trench 131.

Moreover, the conductive terminal 15 has a conductor in the sleeve 11 and below the cam swing rod 111. A conductive reed 151 is positioned below the conductive terminal 15. The conductive reed 151 is in contact to the battery electrode 141 at a top of the light-emitting unit 14. By the expansion of the conductive reed 151, the bottom of the conductive terminal 15 has a gap H distant from the light-emitting unit 14. Further, the casing bottom of the light-emitting unit 14 is fixed with the light-emitting body 143 which is LEDs. And a casing top of the light-emitting unit 14 receives a light-emitting body 143 and has a long conductive pin 142 extended from the light-emitting body 143. The long conductive pin 142 is not in contact with the battery electrode 141. A short conductive pin 144 of the light-emitting body 143 is directly in contact to another battery electrode 145. Since the light-emitting body 143 does not contact the bottom of the conductive terminal 15; thereby, the circuit of the light-emitting unit 14 is shorted.

Besides, a lower end of the conductive terminal 15 of the light-emitting unit 14 resists against the conductive enclosure 25. Thereby, the conductive enclosure 25 enclosures the refill 23 and can be integrally formed with the refill 23.

A transparent inner tube 22 is installed in the transparent outer tube 21. The transparent inner tube 22 is an auxiliary transparent tube, and thus it can be neglected. The spring 24 encloses a lower end of the refill 23 and resists against the conductive enclosure 25. The spring 24 is elastic and thus it can resists upwards against the conductive enclosure 25 so that the refill 23 and the conductive enclosure 25 resists upwards.

Figure 6:
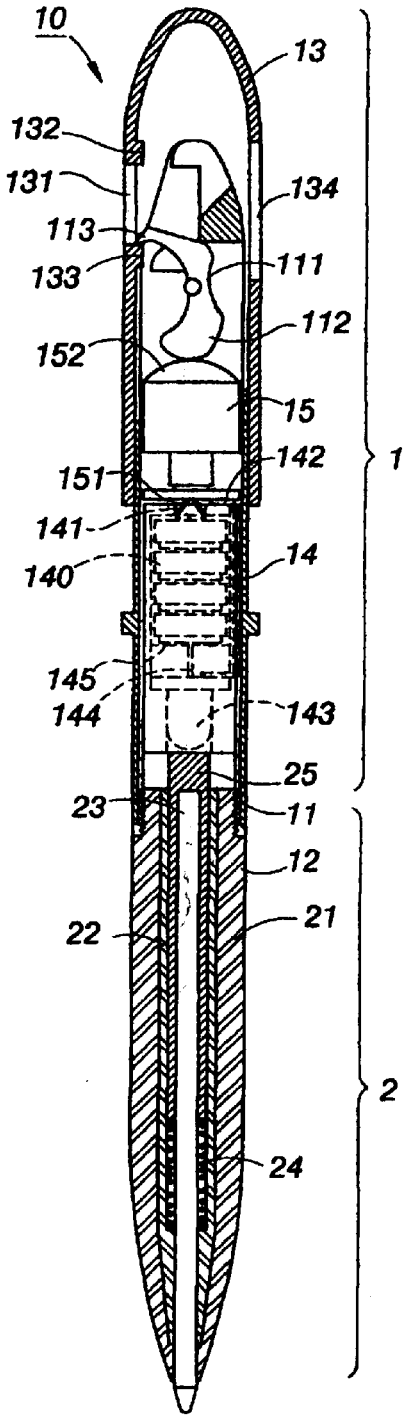
FIG. 6 is a schematic view showing the operation of the light-emitting pen of the present invention.
Figure 7:
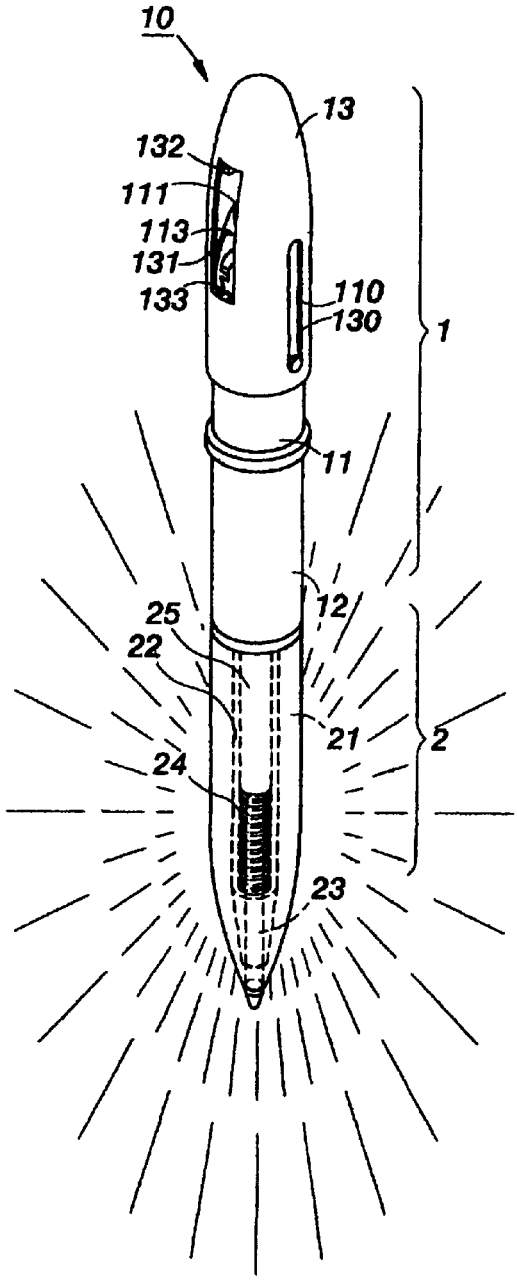
FIG. 7 is a schematic view showing the lighting up of the light-emitting pen of the present invention.

With reference to FIG. 6, when the cover 13 extends upwards, the lower block 133 will resist against the hook plate 113 to move upwards and the cam 112 at another end will swing downwards to push conductive enclosure 25 to swing downwards. For reducing the friction force between the conductive terminal 15 and the cam 112, it is preferably that the upper end of the conductive terminal 15 has a cambered end 152. When the conductive terminal 15 is pressed to resist to the light-emitting unit 14, the conductive pin 142 of the light-emitting unit 14 will contact the conductive terminal 15 so that circuit in the light-emitting unit 14 will conduct. Then the light-emitting body 143 will light up (referring to FIG. 7). When the light-emitting unit 14 pushes downwards so that a bottom thereof resists against the conductive enclosure 25 to move downward; as a result, the refill 23 protrudes out for writing.

Figure 8:
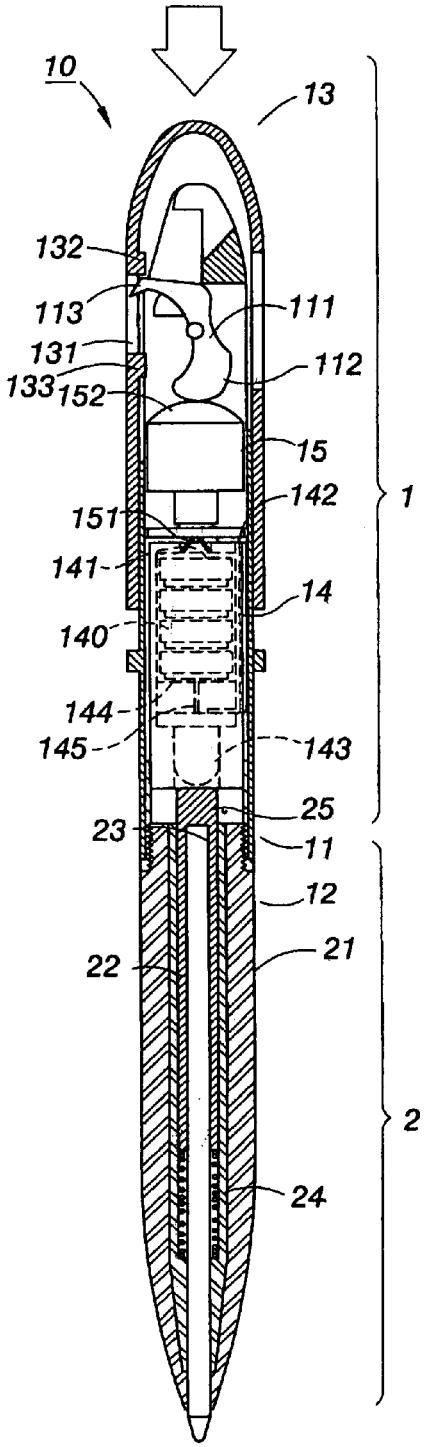
FIG. 8 is a schematic view showing the closing of the light-emitting pen of the present invention.

Moreover, as shown in FIG. 8, when the cover 13 retracts backwards, the upper block 132 will press the hook plate 113 to move downward and the cam 112 at another end swings upwards to release the pressure to the conductive terminal 15. By the resilient force of the conductive reed 151, the conductive terminal 15 is separated from the top of the light-emitting unit 14 so that the light-emitting unit 14 is shorted and the light-emitting unit 14 does not light up. Further, the spring 24 in the pen tube 2 expands to make the refill 23 to reduce into the transparent outer tube 21.

Figure 9:
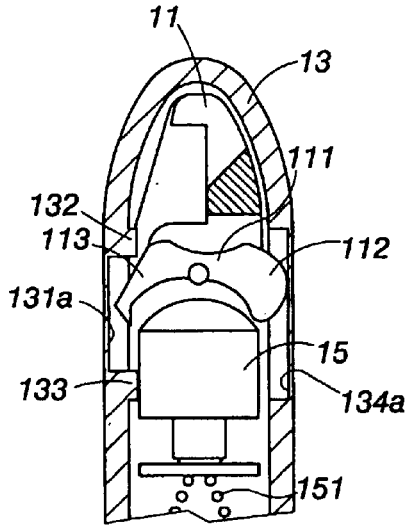
FIG. 9 shows the embodiment about the pulling of the light-emitting pen of the present invention.
Figure 10:
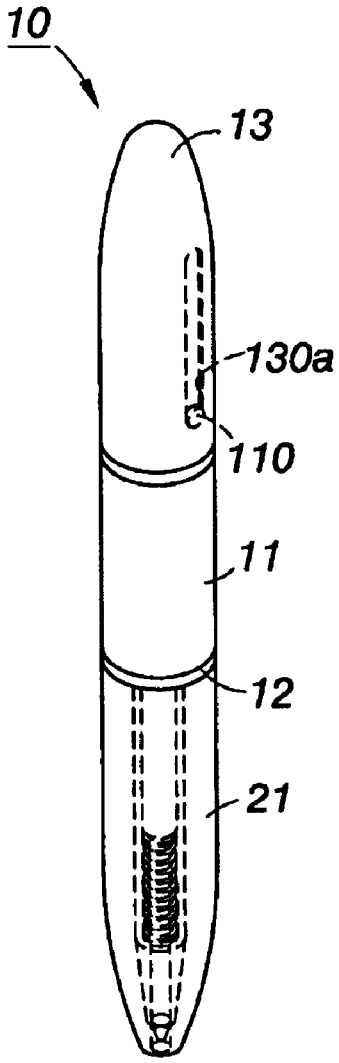
FIGS. 10 and 11 show the appearance of the light-emitting pen in one embodiment of the present invention.

With reference to FIG. 9, the cover 13 has trenches 131, 135 for preventing the hook plate 113 and cam 112 from colliding the inner wall of the cover 13. For having a beautiful outlook, the two trenches can be replaced by inner slots 131*a* and 134*a* which are hidden in the interior of the cover 13 or other notches so as to have a beautiful outlook, as shown in FIG. 10.

Similarly, the guide recesses 130 at two sides of the cover 13 can be replaced by inner guide recesses 130*a* which is hidden in the inner side of the cover 13 so as to be embedded by the studs 110 at two sides of the sleeve 11.

Figure 11:
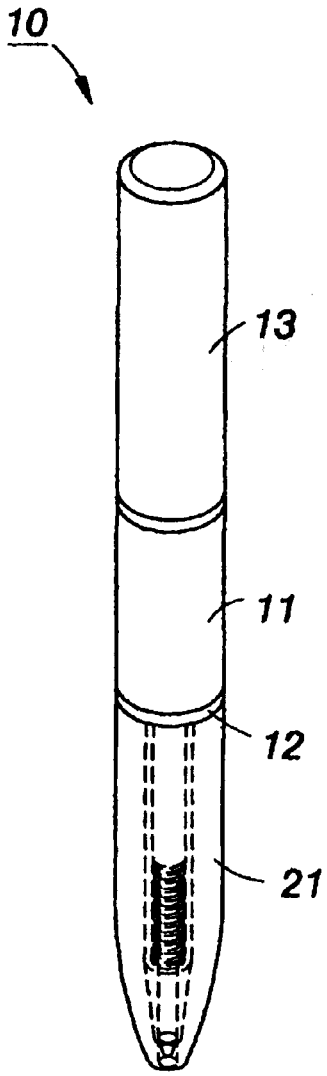

As shown in FIG. 11, another embodiment of the present invention is illustrated, in this the present invention that the cover 13 is different from the former one so that the pen is like a general pen instead of a light-emitting pen and the way for protruding the refill 23 can not be seen.

Figure 12:
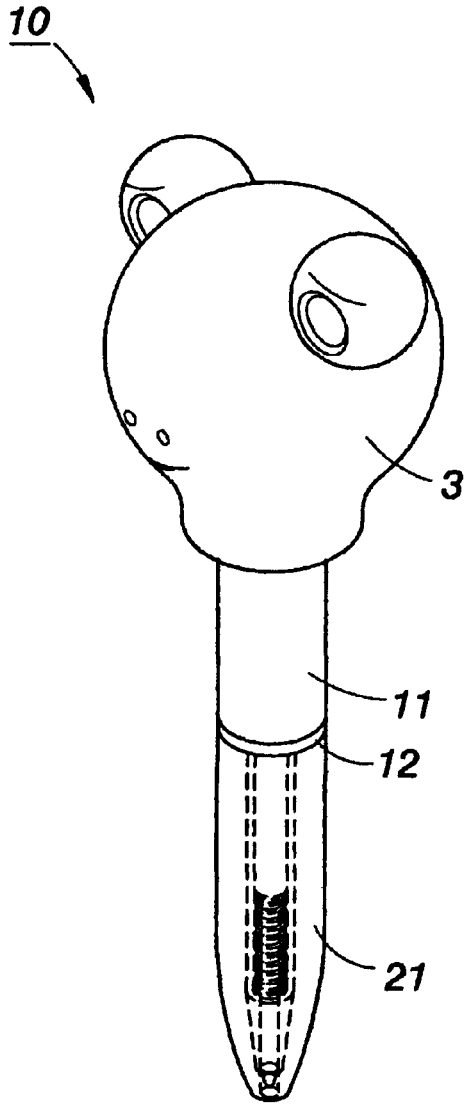
FIG. 12 is a schematic view showing the decoration of the light-emitting pen of the present invention.

Next, a decoration 3 is installed on the cover 13 (referring to FIG. 12). The decoration 3 may be one of cartoons or dolls or other shapes. A lower edge of the decoration 3 resists against the cover 13 so that the cover 13 and the decoration 3 can be pulled synchronously. Thereby, the light-emitting pen 10 can light up and is attractive to children.

Advantages of the present invention will be described herein. In the present invention, the power supply is hidden so as to have a beautiful outlook. The pulling of the cover can prevent the mistake of incorrectly lighting up so that power is saved. Decorations on the cover can present an attractive outlook, which is not effect the operation of the light-emitting pen.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A light-emitting pen with pullable cover comprising an upper portion and a lower portion; the upper portion being a control portion and the lower portion being a pen tube; the pen tube being formed by a transparent outer tube; a refill within the transparent outer tube; and a spring being at a lower end of the refill so that the refill is retained in a reduced state in the pen tube; the control portion including the sleeve, the transparent outer tube connected to the sleeve; a cover on the sleeve; a light-emitting unit in the sleeve and a lower end thereof pressing the refill; a conductive terminal in the sleeve and on the light-emitting unit; wherein a cam swing rod is pivotally installed within a top of the sleeve; one side of the cam swing rod is a cam and another side thereof is a hook plate; an inner wall of the cover is installed with an upper block and a lower end thereof is a lower block; the upper and lower blocks are on the upper and lower sides of the hook plate; a bottom end of the conductive terminal is installed with a conductive reed; the conductive reed resists against a top of the light-emitting unit and is in contact with a battery electrode at a top thereof; by the expansion of the conductive reed, the conductive terminal has a gap from a top of the light-emitting unit; and a casing top of the light-emitting unit receives a light-emitting body and has a long conductive pin extended from the light-emitting body; the long conductive pin is not in contact with the battery electrode; a short conductive pin of the light-emitting body is directly in contact to another battery electrode.

2. The light-emitting pen as claimed in claim 1, wherein a top of the refill is installed with a conductive enclosure and a top of the conductive enclosure resists against a bottom of the light-emitting unit and a lower end of the conductive enclosure resists against the spring.

3. The light-emitting pen as claimed in claim 2, wherein the refill, conductive enclosure and spring are installed with a transparent inner tube and the transparent inner tube is installed within the transparent outer tube.

4. The light-emitting pen as claimed in claim 1, wherein two sides of the cover are installed with recesses which penetrates through a wall of the for embedding studs at two sides of the pen tube.

5. The light-emitting pen as claimed in claim 1, wherein two sides of the cover are formed with recesses which do not penetrate through a wall of the cover for embedding studs at two sides of the pen tube 2.

6. The light-emitting pen as claimed in claim 1, wherein an inner wall of the cover corresponding to the hook plate is installed with at least one trench which penetrates through a wall of the cover; and the inner wall corresponding to the cam is installed with at least one trench which penetrates through the inner wall.

7. The light-emitting pen as claimed in claim 1, wherein an inner wall of cover corresponding to the hook plate is installed with at least one trench which does not penetrate through an wall of the cover; and the inner wall corresponding to the cam is installed with at least one trench which does no penetrate through the inner wall.

8. The light-emitting pen as claimed in claim 1, wherein an upper section of the conductive terminal is a cambered end.

9. The light-emitting pen as claimed in claim 1, wherein a metal connected ring is installed below the sleeve and the metal connecting rind is screwedly connected to the transparent outer tube.

* * * * *